United States Patent [19]

Trotta

[11] Patent Number: 4,777,722

[45] Date of Patent: Oct. 18, 1988

[54] COMBINATION OVERCOVER FOR SAFETY RAZOR

[75] Inventor: Robert A. Trotta, Pembroke, Mass.

[73] Assignee: The Gillette Company, Boston, Mass.

[21] Appl. No.: 133,290

[22] Filed: Dec. 14, 1987

[51] Int. Cl.[4] ..... B26B 21/40

[52] U.S. Cl. ..... 30/84; 30/77; 30/90; 206/349; 206/352

[58] Field of Search ..... 30/90, 77, 84, 79, 47; 206/249, 252, 254, 256

[56] References Cited

U.S. PATENT DOCUMENTS

| | | | |
|---|---|---|---|
| D. 274,010 | 5/1984 | Iten | D28/47 |
| 1,276,022 | 8/1918 | Brasier | 30/77 |
| 2,342,207 | 2/1944 | McVey | 20/90 |
| 3,078,569 | 2/1963 | Sidney et al. | 30/77 |
| 3,172,202 | 3/1965 | Sooter | 30/90 |
| 3,880,284 | 4/1975 | Pomfret | 206/354 |
| 4,245,388 | 1/1981 | Dawidowitz et al. | 30/47 |
| 4,425,705 | 1/1984 | Chen | 30/84 |
| 4,461,079 | 7/1984 | Craffone et al. | 30/79 |
| 4,476,630 | 10/1984 | Byrne | 30/84 |
| 4,601,392 | 7/1986 | Althaus | 206/349 |
| 4,624,051 | 11/1986 | Apprille, Jr. et al. | 30/84 |
| 4,692,686 | 9/1987 | Motta et al. | 30/90 |
| 4,709,476 | 12/1987 | Shurtleff et al. | 30/90 |

*Primary Examiner*—Frank T. Yost
*Assistant Examiner*—Scott A. Smith
*Attorney, Agent, or Firm*—Owen J. Meegan; Aubrey C. Brine; Scott R. Foster

[57] ABSTRACT

A safety razor assembly is provided having a removable cap slideably received in interfitting engagement with the razor head. The cap is provided with a shaving aid member having a skin contacting surface disposed adjacent, and extending along the forward edge thereof, and a cover wall. In the shaving mode, the cap is positioned on the shaving head with the cover wall below the head and the skin contacting surface disposed adjacent the blade edges in a preferred shaving geometry. The cap may be removed and positioned on the shaving head in the inverted position, with the cover wall disposed over the blade edges for protection of the blades, or adjacent items, during non-use of the safety razor.

14 Claims, 3 Drawing Sheets

COMBINATION OVERCOVER FOR SAFETY RAZOR

BACKGROUND OF THE INVENTION

The present invention relates to a safety razor assembly and more particularly to a safety razor assembly having a removable protective cap or overcover which is received in interfitting engagement onto the razor head.

Recent advances in safety razor technology have brought about safety razor assemblies which are of less bulk than shaving units of the prior art and are of lighter material due to both the design and materials employed. With the advent of the disposable razor, the limitation on size and weight are of increased importance to provide a shaving implement which is more easily packed and carried with other toiletry items. The disposable razor is generally provided with a cap which fits over the head of the razor to protect the blade edges from contacting other items during storage or transport of the safety razor assembly, the cap being easily removable from the razor head during shaving and easily installed on the razor head should the razor be retained for further use.

A further step forward in the development of shaving systems may be found in U.S. Pat. No. 4,624,051 issued to Dominique V. Apprille Jr. et al and assigned to the assignee of the present invention, in which a shaving aid member that includes an effective amount of water leachable shaving aid composition is employed to reduce the discomfort of frictional drag of the razor across the skin and resultant irritation to the user. The incorporation of shaving aids of this type have proved successful and have met with user acceptance in the wet shaving marketplace.

In view of the above cited advancements, it is deemed that a need has arisen to provide a safety razor of the disposable type which is miniaturized in construction however employing a shaving aid material to provide shaving comfort to the user.

It is therefore an object of the present invention to provide a safety razor assembly which is lightweight, of simple construction, and easy to employ in the shaving process.

Another object of the invention is to provide a safety razor assembly which has decreased frictional drag of the blade edge across the skin, and therefore provides greater comfort to the user.

A further object of the invention is to provide a safety razor assembly of the disposable type which is easily transported and stored, wherein the blade edge or blade edges are protected from contact with other objects being transported or stored with the assembly, and which incorporates a shaving aid.

SUMMARY OF THE INVENTION

The above objects and other objectives which will become apparent as the description proceeds are accomplished by providing a safety razor assembly comprising a handle having a shaving head disposed at the upper end thereof, the shaving head comprising a pair of side walls having blade means disposed therebetween with the cutting edge extending forwardly from the head. A removable cap is provided comprising wall structure including a cover wall extending laterally over the width of the cap and having a guard shaving aid member having a skin contacting extending along the forward edge thereof, latching means is disposed on the wall structure for retaining the cap on the shaving head with the guard surface disposed adjacent the blade means cutting edge and the cover wall disposed below the shaving head. The cap may be inverted and the latch means disposed on the wall structure is effective to retain the cap on the shaving head with the cover wall disposed over and substantially concealing the blade means cutting edge.

The shaving aid member may comprise a shaving aid composition formed of an effective amount of water leachable material and in a preferred structure, the material is composed of a polymer blend of water soluble and insoluble polymer materials.

The skin contacting surface of the shaving aid member is so oriented on the cap as to provide the proper shaving geometry when combined with the rear skin engaging surfaces of the shaving head with the cap retained on the shaving head, the cover wall disposed below the shaving head, and the blade means cutting edge revealed for utilization in the shaving process.

BRIEF DESCRIPTION OF THE DRAWING

The foregoing and other features of the invention will be more particularly described in connection with the preferred embodiment, and with reference to the accompanying drawing wherein.

DESCRIPTION OF THE PREFERRED EMBODIMENT

Figure 1:
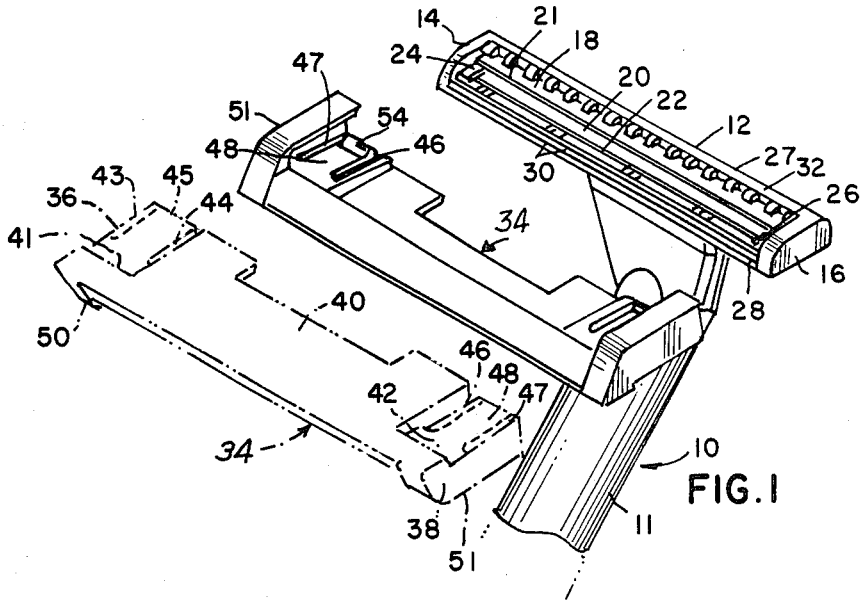
FIG. 1 is an exploded perspective view partially in phantom lines showing a safety razor assembly constructed in accordance with the teachings of the present invention.

Referring now to the drawing and in particular to FIG. 1, there is shown a safety razor assembly 10 constructed in accordance with the teachings of the present invention. The safety razor assembly 10 comprises a handle 11 having a shaving head 12 disposed at the upper end thereof, the handle 11 being slightly angled at its upper end to give the shaving head 12 a proper attitude for shaving when the handle 11 is held in the hand of the user.

The shaving head 12 comprises a pair of side walls 14 and 16 having a pair of cutting blades 18 and 20 extending between the walls with blade cutting edges 21 and 22 projecting forwardly and fixed between the walls 14 and 16. The blades 18 and 20 are disposed in staggered relation one above the other, with a pair of spacers 24 and 26 disposed therebetween. The blades 18 and 20 extend forwardly from a rear wall 27 of the shaving head toward a guard surface 28 located between the side walls 14 and 16, the guard surface being provided with a plurality of laterally extending grooves 30 and being located in a desired geometry with reference to the blades 18 and 20 and a rear skin contacting surface 32 of the shaving head.

Those elements of the safety razor assembly thus far described are to be found on a disposable razor which is exemplified by that manufactured by the assignee of the present invention under the trademark MICRO-TRAC. Although it should be understood that the present invention as will be described hereinafter is applicable to other safety razor structure within the teachings of the present invention.

Referring now to FIG. 1, taken in conjunction with FIGS. 2 through 5, the safety razor assembly 10 further comprises a removable cap 34 comprising a pair of side walls 36 and 38, and a cover wall 40 disposed between the side walls. The cover wall 40 comprise a pair of stepped portions 41 and 42 at either side thereof, which are attached to the lower edge of the side walls 36 and 38 respectively. The stepped portion 41 has a pair of elongated slots 43 and 44 formed at the rear of the cover wall which serve to define a flexible tab 45 and the stepped portion 42 has a pair of similar elongated 46 and 47 formed adjacent the rear of the cover wall which serve to define a flexible tab 48 similar to the flexible tab 45.

Each of the side wall members 36 and 38 has an inwardly extending flange 50 and 51 respectively which is disposed in spaced relation with the cover wall 40. The flange 50 and tab 45 on the one side, and the tab 48 and flange 51 on the other side of the cap 34 provide a cavity at either side of the cap for receiving the shaving head 12 in interfitting engagement between the cover wall 40 and the flanges 50 and 51. A pair of triangular detents 52 and 54 are disposed on the inner surface of the tabs 45 and 48 respectively and serve to retain the shaving head 12 in interfitting engagement in the cavities provided. The detents 52 and 54 are spaced from the flanges 50 and 51 a lesser distance than the thickness of the head 12 and are provided with a sloping surface which contacts the rear wall 27 of the shaving head 12 with the cap 34 positioned such that the cover wall 40 is either above the shaving head 12, or below the shaving head 12.

It should be understood that an order to obtain the flexibility in the free ends of the tabs 45 and 48, the removable cap 34 is designed as a unitary element which is formed of resilient plastic material. A preferred material is an acrylic resin although other materials well known in the art may be employed which would be effective to provide flexibility to the structure and retain the shaving head 12 in interfitting engagement with the cap 34 while allowing easy removal and assembly of the cap onto the shaving head.

Referring now to FIGS. 2 through 6, the cap 34 is provided with an aperture 56 which extends along the forward face of the cap between the walls 36 and 38. A shaving aid member 58 of moldable or extrusion oriented polymeric material that includes an effective amount of a water leachable shaving aid composition is permanently and substantially immovably affixed to the cap 34 by insertion into the aperture 56 with its upper surface protruding slightly above the rear surface of the aperture.

The shaving aid member 58 is preferably a polymer blend that contains at least one water soluble polymeric shaving aid material and at least one water insoluble polymeric shaving aid material, the water soluble material being such that it is leached out of the member on contact with water. The nature and relative proportions of the water soluble and water insoluble polymeric material in the polymer blend should be such that the member has adequate mechanical strength both as initially produced and after a significant amount of the water soluble material has been leached out, the quantity of the water soluble material being sufficient to provide effective shaving assistance, such as lubrication, for the entire expected life of the blade or blades. Such a material has been shown and described in detail in the aforementioned U.S. Pat. No. 4,624,051 issued to Aprille Jr. et al which is herein incorporated by reference. It is therefore considered that no further details of the material be herein discussed, but for to indicate that the shaving aid member 58 may be a sliced portion of an extruded or molded elongated element for ease of manufacture and to effect a simple construction of the cap 34.

Figure 7:
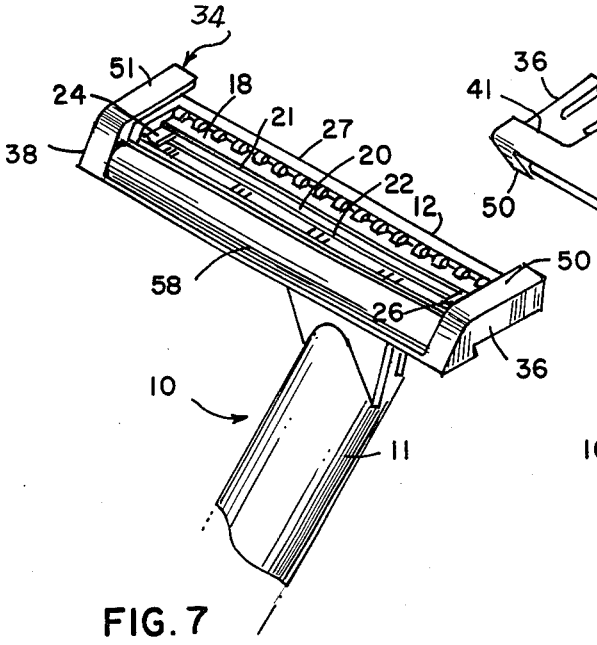
FIG. 7 is an elevational perspective view showing the safety razor assembly of FIG. 1 in the shaving mode.
Figure 8:
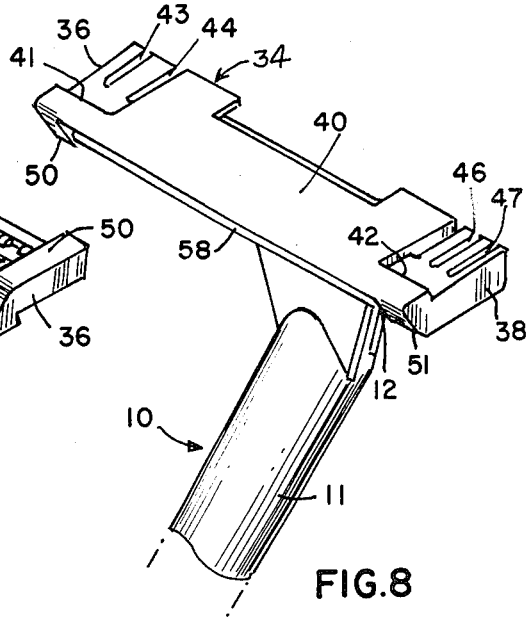
FIG. 8 is an elevational perspective view showing the safety razor assembly of FIGS. 1 and 7 in the non-shaving mode with the blade edges concealed.
Figure 2:
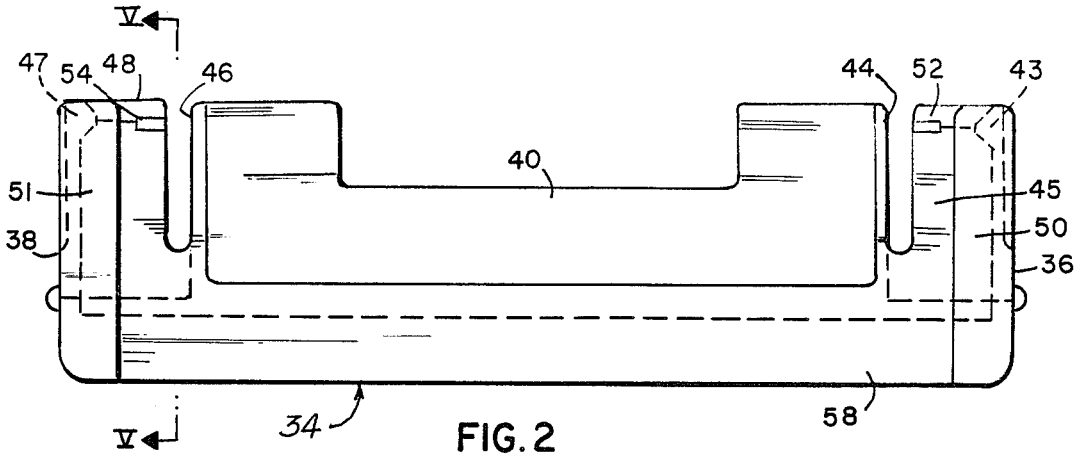
FIG. 2 is a top plan view showing details of the cap element shown in FIG. 1.
Figure 3:
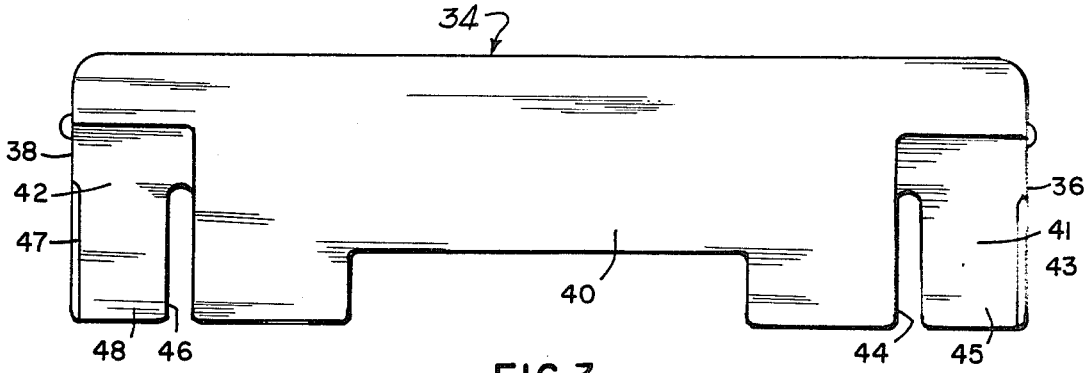
FIG. 3 is a bottom plan view showing further details of the structure of FIG. 2.
Figure 4:
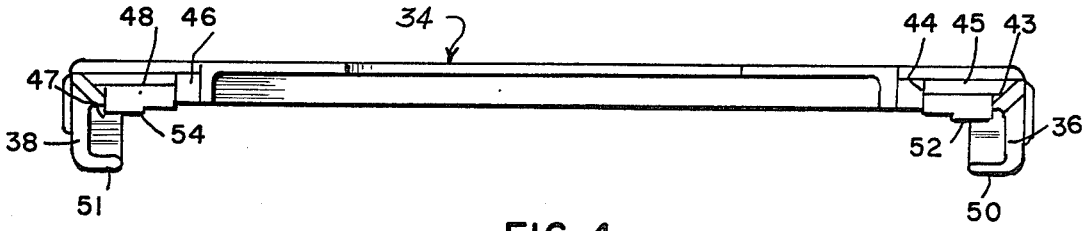
FIG. 4 is a rear elevational view showing a portion of the cap of FIGS. 2 and 3.
Figure 5:
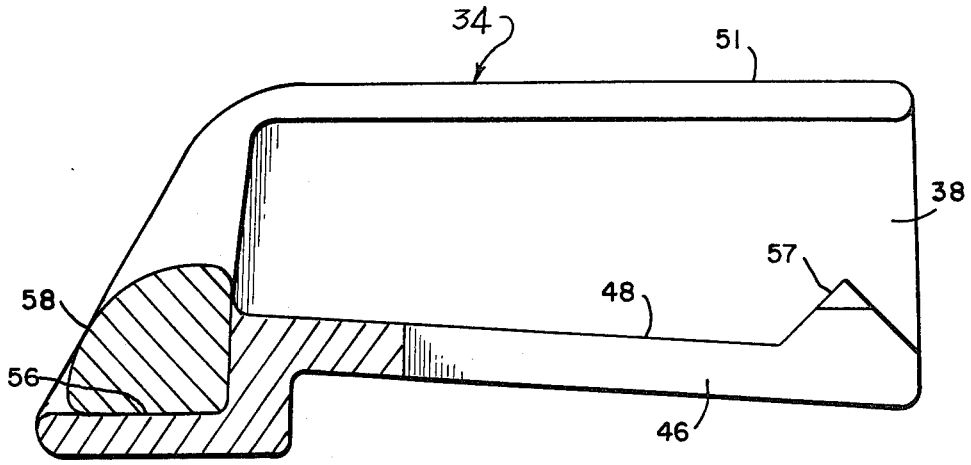
FIG. 5 is an elevational sectional view taken along the lines V—V of FIG. 2 showing features of a portion of the structure of FIGS. 2 through 4.
Figure 6:
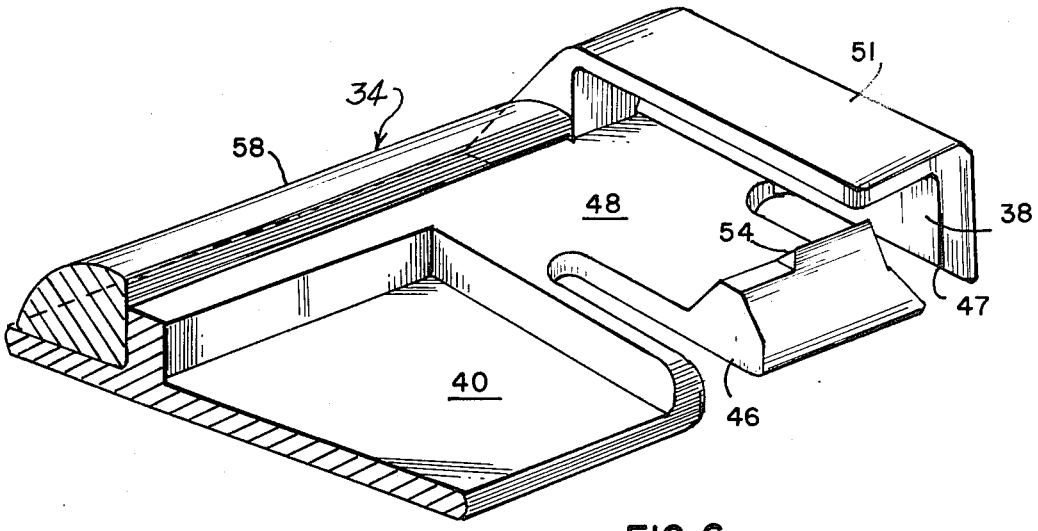
FIG. 6 is a fragmentary sectional perspective view showing a portion of the structure of FIGS. 2 through 5 in detail.

Referring now to FIGS. 7 and 8, it will be observed that in FIG. 7, the removable cap 34 has been assembled onto the shaving head 12 with the cover wall 40 disposed below the shaving head and the shaving aid member 58 disposed adjacent the guard surface 28. The shaving aid member 58 precedes both the guard surface 28 and the rear skin contacting surface 32 in contacting the skin of the user and therefore deposits a film of shaving aid material onto the skin prior to the shaving process. In the position as shown, the cap 34 is retained onto the shaving head 12 by virtue of the detents 52 and 54 contacting the lower edge of the rear wall 27.

In FIG. 8, the cap 34 is shown in its cover position wherein the cover wall 40 extends over the blade edges 21 and 22 concealing the blade edges from contact with adjacent articles. In the position shown in FIG. 8, the tabs 45 and 48 are disposed adjacent the top of the head 12 and the detents 52 and 54 are in contact with the upper edge of the rear wall 27 retaining the head in interfitting engagement in the cap 34.

From the foregoing, it has been shown that the disclosed safety razor assembly 10 may be manufactured having a miniaturized shaving head and also be provided with a shaving aid member 58 which is part of the overcover or cap member generally provided with such a razor. For this reason, a more simple and lightweight construction is provided wherein the cap 34 becomes part of the safety razor assembly employed during the shaving process.

I claim:

1. A safety razor assembly comprising a handle having a shaving head disposed at the upper end thereof, said shaving head comprising a pair of side walls having blade means disposed therebetween with the cutting edge thereof extending forwardly therefrom, and a removable cap, said cap comprising wall structure including a cover wall extending laterally over the width of said cap and having a shaving aid member having a skin contacting surface extending along the forward edge thereof and latching means disposed on said wall structure for retaining said cap on said shaving head with said skin contacting surface disposed adjacent said blade means cutting edge and said cover wall disposed below said shaving head, and for retaining said shaving head with said cover wall disposed over, and substantially concealing said blade means cutting edge.

2. A safety razor assembly as set forth in claim 1 wherein said shaving aid member comprises a shaving aid composition formed of an effective amount of water-leachable material.

3. A safety razor assembly as set forth in claim 1 wherein said cap wall structure further comprises a pair of side wall members, one disposed at either side of said cover wall, each said side wall member having an inwardly extending flange disposed in spaced relation with said cover wall and forming a cavity for receiving said shaving head in interfitting engagement with said cover wall disposed below said shaving head and said cavity further being effective to receive said shaving head in interfitting engagement therewith with said cover wall disposed above said shaving head.

4. A safety razor assembly as set forth in claim 3 wherein said cover wall comprises a pair of substantially flexible tabs formed therein, each having a free end extending rearwardly, one said tab adjacent each of said side wall members and each tab having a portion thereof underlying a respective flange of a side wall member, each said tab having a detent member disposed at the free end thereof for containing a portion of a rear surface of said shaving head with said shaving head in said interfitting engagement with said cover wall disposed below said shaving head, and for contacting a portion of said rear surface of said shaving head with said cover wall disposed above said shaving head.

5. A safety razor assembly as set forth in claim 1 wherein said blade means comprises a pair of blades, one disposed above the other in staggered relation.

6. A safety razor assembly as set forth in claim 1 wherein said movable cap is constructed of a resilient plastic material.

7. A safety razor assembly as set forth in claim 1 wherein said removable cap is constructed of an acrylic resin material.

8. A safety razor assembly as set forth in claim 1 wherein said shaving aid member comprises a material composed of a polymer blend of water soluble and insoluble polymer materials.

9. A safety razor assembly as set forth in claim 2 wherein said cap wall structure further comprise a pair of side wall members, one disposed at either side of said cover wall, each said side wall member having an inwardly extending flange disposed in spaced relation with said cover wall and forming a cavity for receiving said shaving head in interfitting engagement with said cover wall disposed below said shaving head, and said cavity further being effective to receive said shaving head in interfitting engagement therewith with said cover wall disposed above said shaving head.

10. A safety razor assembly as set forth in claim 9 wherein said cover wall comprises a pair of substantially flexible tabs formed therein, each having a free end extending rearwardly, one said tab adjacent each of said side wall members and each said tab having a portion thereof underlying a respective flange of a side wall member, each said tab having a detent member disposed at the free end thereof for contacting a portion of a rear surface of said shaving head in said interfitting engagement with said cover wall disposed below said shaving head and for contacting a portion of said rear surface of said shaving head when said cover wall is disposed above said shaving head.

11. A safety razor assembly as set forth in claim 10 wherein said blade means comprises a pair of blades one disposed above the other in staggered relation.

12. A safety razor assembly as set forth in claim 11 wherein said removable cap is constructed of a resilient plastic material.

13. A safety razor assembly as set forth in claim 12 wherein said resilient plastic material is an acrylic resin.

14. A safety razor assembly as set forth in claim 13 wherein said water-leachable material is composed of a polymer blend of water soluble and insoluble polymer materials.

* * * * *